United States Patent [19]

Kulig

[11] 4,274,579

[45] Jun. 23, 1981

[54] CELLULAR TRAY-TYPE CARTON

[75] Inventor: Francis V. Kulig, Morris, Ill.

[73] Assignee: Federal Paper Board Company, Inc., Montvale, N.J.

[21] Appl. No.: 68,647

[22] Filed: Aug. 22, 1979

[51] Int. Cl.[3] ..... B65D 5/48

[52] U.S. Cl. ..... 229/28 R

[58] Field of Search ..... 229/28 R, 29 B

[56] References Cited

U.S. PATENT DOCUMENTS

| | | | |
|---|---|---|---|
| 2,759,652 | 8/1956 | Burgess | 229/28 R |
| 3,175,751 | 3/1965 | Burgess | 229/28 R |
| 3,514,031 | 5/1970 | Burgess | 229/28 R |
| 3,743,168 | 7/1973 | Forbes, Jr. | 229/28 R |
| 4,117,972 | 10/1978 | Sellors | 229/28 R |

*Primary Examiner*—Davis T. Moorhead

*Attorney, Agent, or Firm*—Guy A. Greenawalt

[57] ABSTRACT

A multi-cell tray-type rectangular carton is disclosed which is formed in collapsed condition from a cut and scored blank of paperboard, or similar foldable sheet material, and which is adapted to be opened up into a tube with two rows of article receiving pockets in side by side relation and separated by a double thickness partition, with each row of pockets formed by depressing a cut and scored panel, which is taken from the top wall, and which is depressed so that a portion lies on the bottom wall with abutment forming edges which engage cooperating edges of panels hinged to the bottom edge of the double thickness partition and which hold the panel in cell forming position.

10 Claims, 10 Drawing Figures

CELLULAR TRAY-TYPE CARTON

BACKGROUND OF THE INVENTION

This invention relates to packaging and is particularly concerned with improvements in a compartmented tray-type container which is adapted to be fabricated of paperboard or similar foldable sheet material.

In the marketing of articles, such as, candy Easter eggs and other food products of a similar nature, cellular cartons formed of paperboard or similar material have been provided heretofore which have been adapted for fabrication initially in flattened or collapsed condition so that they could be opened up into the form of a rectangular carton, so as to receive the articles in the cells thereof. Generally, a transparent overwrap has been applied to cover the top of the article receiving cells and provide protection against handling or removal of the individual articles while leaving the same capable of visual inspection by a prospective purchaser. In some arrangements a top panel has been provided for display advertising or other printed matter. However, it has been found that there is need for improvement in this type of container to provide greater rigidity in the set-up condition and to render the carton more acceptable to the product manufacturer or distributor.

It is a general object of the invention to provide a multi-cellular, tray-type carton for marketing confections or similar articles which it is desirable to display in a plurality of open top pockets or cells with accompanying space on the top of the carton for display advertising or the like.

It is a more specific object of the invention to provide a multi-cellular carton, for the purpose described, which may be fabricated from a blank of paperboard, or similar foldable sheet material, which blank is cut and scored so that the carton may be formed in collapsed condition and set up in the form of a tray of generally rectangular shape with two rows of upwardly opening cells which are separated by an upstanding partition of multiple thickness while the individual cells are separated by hinged cross partition members.

It is a still more specific object of the invention to provide a multi-cell tray-type carton of the character described wherein the individual cells in the rows thereof are formed by depressing a panel which is cut from the top wall and which includes hinged cross partition panel members, adapted to move into upright position for separating the individual cells, with the main portion of the panel adapted to move into an overlying position on the bottom wall forming panel.

It is a further object of the invention to provide a cellular carton of the character described wherein the cell forming panel which is depressed so as to lie on the bottom wall is cut to provide edge portions which are adapted to cooperate with abutment forming means on the bottom wall in locking the panel in depressed position.

It is another object of the invention to provide a cellular carton of the character described wherein the locking means which cooperates with the cell forming panel for holding the latter in cell-forming position includes a panel member which is hinged to the row separating partition and which lies on the bottom wall and provides abutment forming edges for engagement by edge portions of the cell-forming panel when the latter is in fully depressed position.

The invention which is herein described and set forth in the claims comprises a cellular carton structure of generally rectangular configuration with two rows of upwardly opening article receiving pockets which rows of pockets are separated by an upstanding partition panel of double thickness of material and each row of which is formed by depressing a hinged panel which is cut from a portion of the top wall panel and which remains connected to the top wall by hinged pocket separating cross partitions when the panel is depressed with means for holding the panel in depressed position.

The foregoing and other objects and advantages of the invention will be more apparent upon consideration of the preferred form of the tray construction which is illustrated in the accompanying drawings wherein like parts are identified by the same numerals throughout the views.

DESCRIPTION OF THE PREFERRED EMBODIMENT OF THE INVENTION

Figure 1:
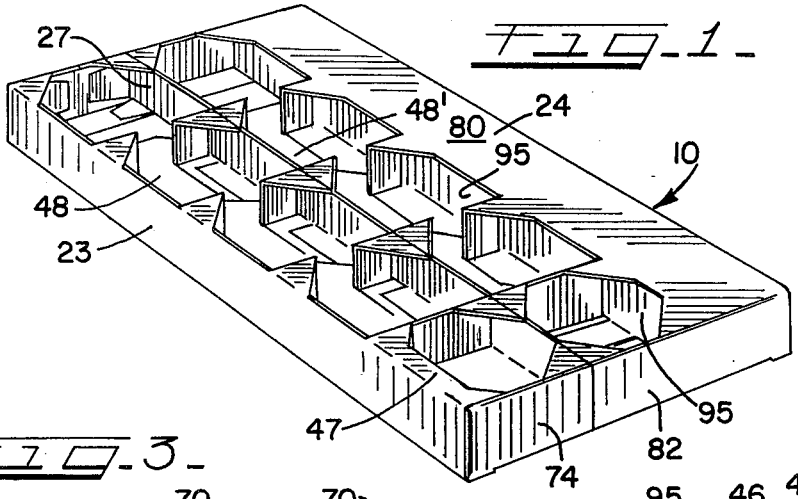
FIG. 1 is a perspective view of a carton in set-up condition which embodies the principle features of the invention.
Figure 3:
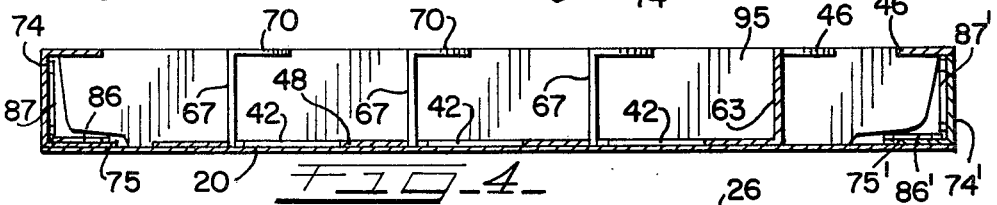
FIG. 3 is a sectional view taken on the line 3—3 of FIG. 2.
Figure 4:
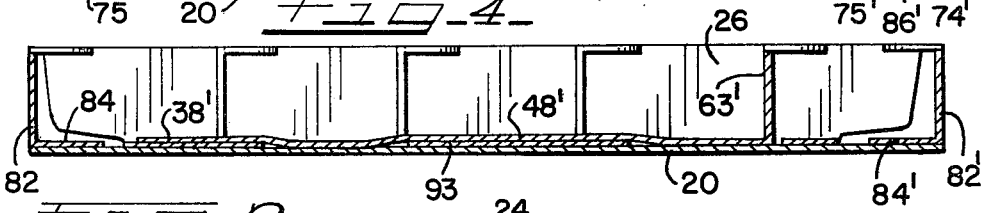
FIG. 4 is a sectional view taken on the line 4—4 of FIG. 2.
Figure 7:
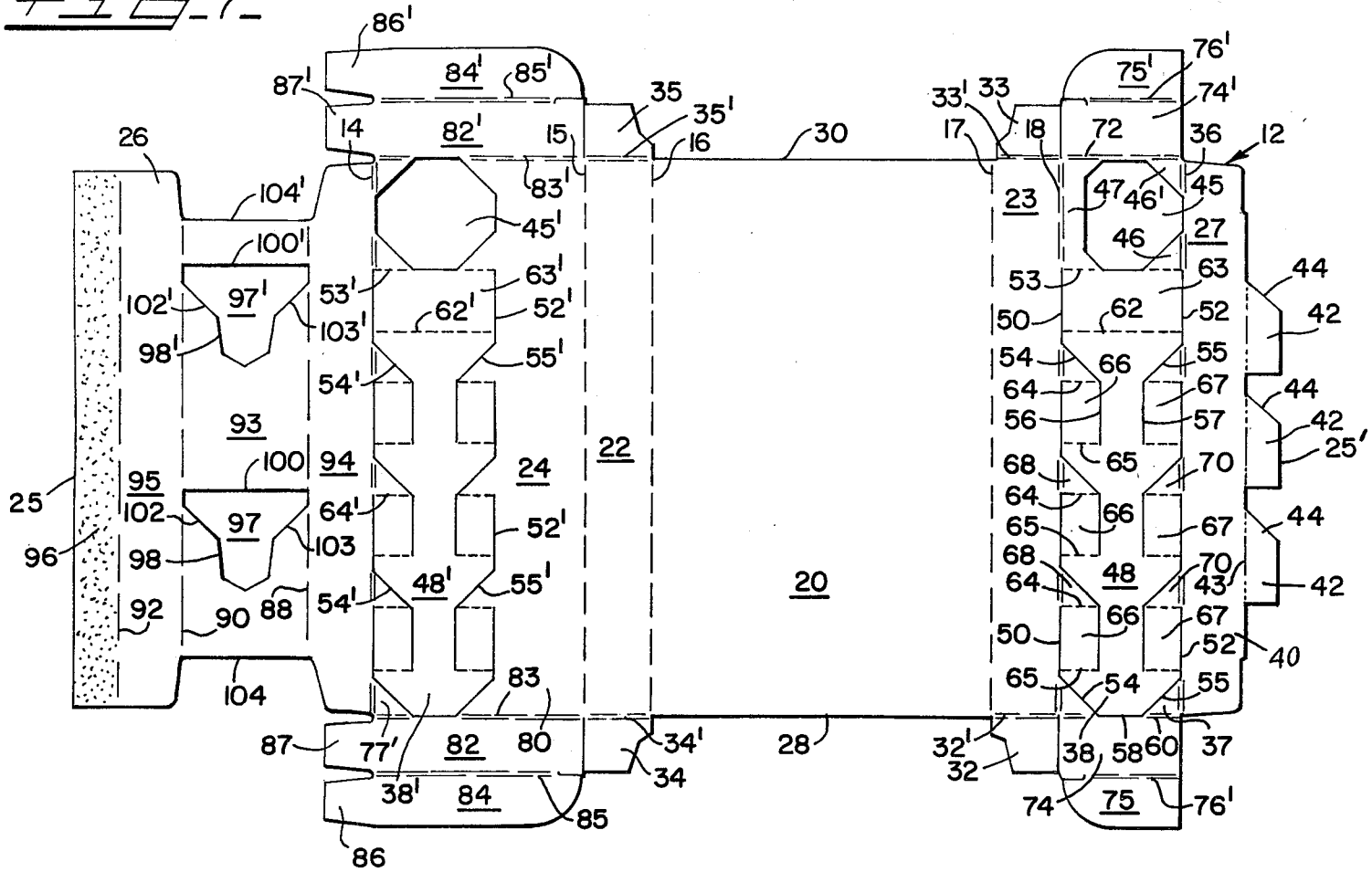
FIG. 7 is a plan view of a paperboard blank which is cut and scored preparatory to the forming of the carton of FIG. 1.

The tray-type container or carton 10, which is illustrated in FIG. 1 in completely set-up condition, has a double row of article accommodating cells or pockets opening upwardly so as to receive two rows or lines of the articles, which may be a food product, such as, for example, candy Easter eggs. A display panel extends along one side of the tray on which printing, such as the manufacturer's name and a description of the product, or the like, may be applied. The carton is formed from blank 12 of paperboard, or other suitable foldable sheet material, which is cut and scored as illustrated in FIG. 7.

The blank 12 is generally rectangular and is divided into a series of integrally connected wall-forming panels of a size which is dependent upon the size and number of articles to be accommodated. In the form shown the blank 12 is divided by a plurality of parallel hinge forming score lines 14, 15, 16, 17 and 18, which extend transversely of the blank and which are spaced longitudinally of the blank, so as to divide the blank into wall and partition panel forming sections, including a bottom wall panel forming portion, or section 20, extending between score lines 16 and 17, adjoining outer side wall panel forming portions, or sections 22 and 23, extending between the score lines 15, 16 and 17, 18, respectively, and a top wall panel and cell forming panel structure 24 extending between the score lines 14 and 15. The dimensions of these blank sections will depend upon the dimensions of the articles which the carton is designed to accommodate. The transverse score lines 14 and 18 are spaced inwardly of the opposite end edges 25 and 25' of the blank, and define with the latter, blank end sections, or end marginal portions 26 and 27, with the former extending between the score line 14 and the end edge line 25, and the latter extending between the score line 18 and the end edge line 25'.

The blank portion 20, which is adapted to form the bottom wall of the carton, extends between cut portions 28 and 30 of the opposite side edges or margins of the blank, with the dimension between lines 28 and 30 defining the length of the completed carton. The outer side wall forming panels 22 and 23 are extended at opposite sides of the blank to form small hinged end closure panels or flaps 32, 33 and 34, 35 with the hinge lines 32', 33' and 34', 35' being score line extensions of the lines defining the edge portions 28 and 30 of the panel 20.

The blank portion or section 27, which extends from the transverse score line 18 to the end edge 25' at the one end of the blank, is subdivided by a score and cutting line 36 into a top wall panel 37, which has cut therein a cell forming structure 38, and a cell row dividing partition forming panel 40, having a dimension in the direction lengthwise of the blank which is somewhat less than the corresponding dimension of the side wall forming panels 22 and 23. The end edge margin of the blank is cut to form three tab formations 42, of identical size and shape, and scored to hinge on a common transverse score line 43, which constitutes the free edge of panel 40. Each of these tab formation 42 is rectangular with an outer top corner area, as viewed in FIG. 7, cut on line 44, at a predetermined angle to the hinge-score line 43.

Figures 5, 6, 8, 9, 10:
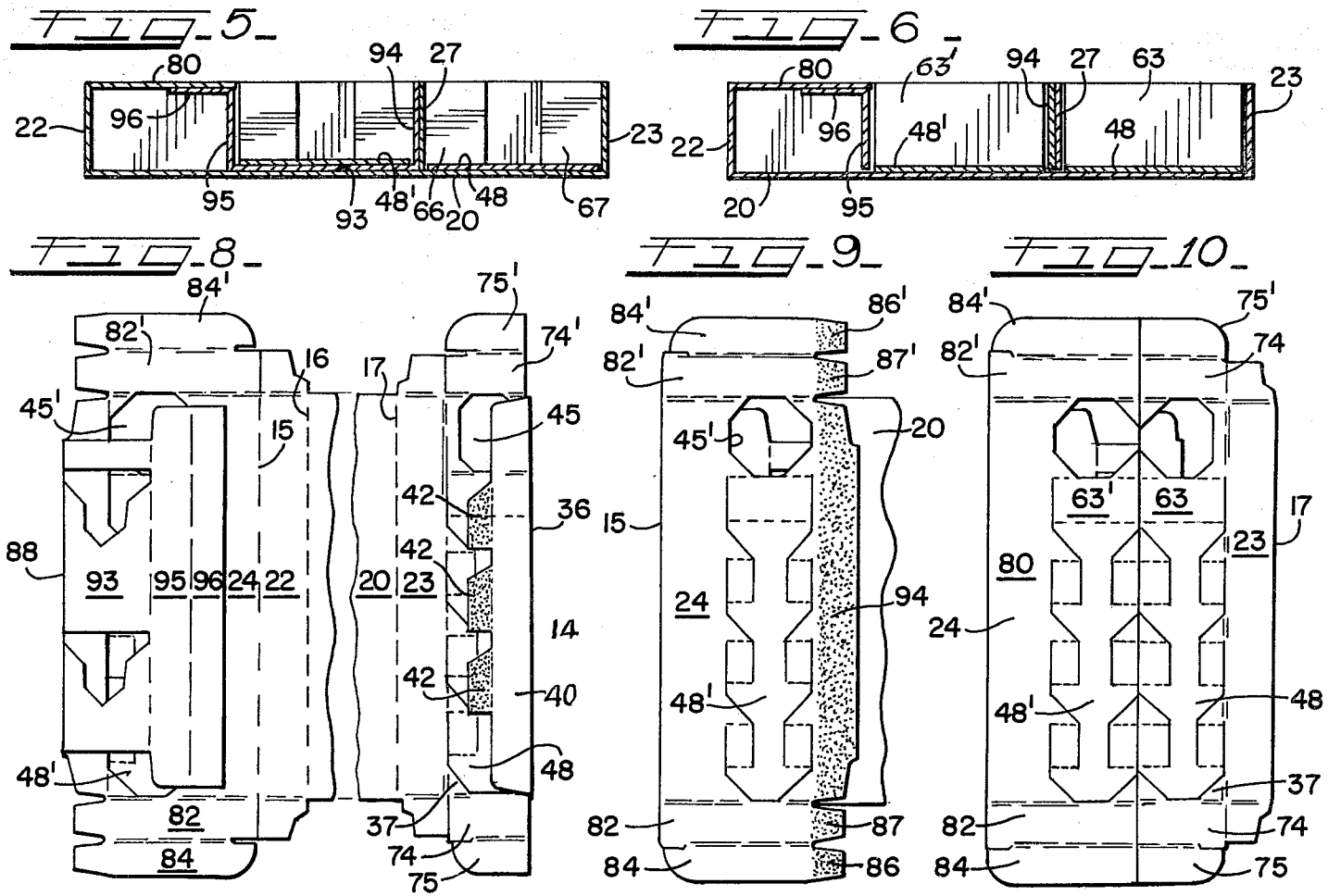
FIG. 5 is a cross-sectional view taken on the line 5—5 of FIG. 2.
FIG. 6 is a cross-sectional view taken on the line 6—6 of FIG. 2.
FIG. 8 is a plan view of the cut and scored blank which illustrates the initial folding steps in the fabrication of the carton.
FIG. 9 is a partial plan view showing a further folding step.
FIG. 10 is a plan view of the completed carton in collapsed condition.

The cell forming panel structure 38 which is cut in the top wall forming panel 37 is cut and scored so that it may be manipulated to form one of the rows of adjoining article receiving pockets or cells which are shown in FIG. 1. In the form shown each row of cells accommodate five articles, or groups of articles, with one end cell in the row being formed by cutting and removing the material so as to form the aperture 45, and leaving intact triangular corner web formations 46, 46' and a relatively narrow strip 47 extending along the score lines 18 and 36. The distance between the line 18 and 36 determines the width of the cells in the outermost row thereof, as viewed in FIG. 1. The other four cells in the row are formed by cutting free an elongate panel 48 on lines which, in part, interrupt the score lines 18 and 36, and by scoring on lines which are spaced transversely of the blank and extend in the lengthwise direction thereof so as to free the panel for folding on the score lines and permitting it to move while in a parallel plane to an offset position which seats major portions of the panel on the bottom wall panel 20, as shown in FIG. 6. The panel 48 is formed by cutting on a series of lines 50 and 52 which are paired and of equal length. The paired lines 50 and 52 extend from and are spaced apart equal distances from a score line 53, with a portion of the latter defining the inner side edge of the end cell 45. The cutting lines 50 and 52 of each pair thereof connect with a pair of inwardly converging cutting lines 54 and 55 which extend to a pair of spaced parallel cutting lines 56 and 57 except for the end pair thereof which terminate at a cutting line 58. The cutting line 58, which is aligned with the end forming edge 28 of panel 20, connects the ends of the end pair of the lines 54 and 55 and frees the end of the panel 48. The cutting line 58 coincides with score line 60 which defines the end edge of the row of cells. The cutting lines 56 and 57 are spaced relative to each other and inwardly of the cutting lines 50 and 52. The panel 37 is scored on the line 62 which is parallel with and spaced inwardly of the line 53 a distance slightly less than the dimension of the sidewall forming panels 22 and 23 in the direction lengthwise of the blank. The score lines 53 and 62 define, with the adjoining pair of cutting lines 50 and 52, a cell cross partition forming panel 63 which constitutes an end hinge panel for the elongate panel 48. The panel 37 is scored at spaced intervals on pairs of lines 64 and 65 which correspond to hinge score lines 53 and 62 and which are interrupted by portions of the panel 48 so as to form with the associated cutting lines 50, 52 and 56, 57 hinge panel portions 66 and 67 which are adapted to hinge into a plane normal to the plane of the top wall forming pair of triangular web portions 68 and 70. The distance between score lines 64 is the same as the distance between the score line 53 and the score line 72 which defines the outermost edge of the end cell 45. At the opposite side of the blank the distance between the edge score line 60 and the first one of the score lines 64 which is adjacent thereto is the same as the distance between score lines 53 and 72 so that the cell dimensions are the same. At each side of the blank an end closure panel 74, 74' extends outward of the score lines 60, 72 with accompanying tuck panels 75, 75' separated therefrom by a hinge score line 76, 76'.

At the other end of the blank 12 the top wall forming panel 24 is cut and scored adjacent the transverse score line 14 to provide the innermost row of article accommodating cells, as viewed in FIG. 1. A portion of the panel 24 constituting a subpanel 77 with dimensions corresponding to the dimensions of the panel 37 is cut and scored to provide the cell structure 38' for forming the innermost row of cells in substantially the same manner as described with respect to the cell forming structure 38 which is cut in the panel 37. The top wall-forming panel 24 has a greater dimension than panel 37 in the lengthwise direction of the blank which permits a display panel 80 to be formed along the one side thereof adjoining the sidewall forming panel 22. As shown, the cell 45' at the one end of the row is cut to provide a slightly different top wall configuration. The elongate panel 48' is formed by cuts and scores in the same manner as panel 48. The blank material at each side thereof is cut to form end closure panels 82, 82' extending outboard of end edge forming score lines 83, 83' and associated tuck panel formations 84, 84' which are separated therefrom by hinge score lines 85, 85'. The end closure panels 82, 82' and the tuck flaps 84, 84' are each provided with glue tabs 86, 86' and 87, 87' extending in the direction of the end edge 24 of the blank and disposed for connecting with the closure panels 74, 74' and tuck flaps 75, 75' so as to form with the panels 32, 34 and 33, 35 end closure members of conventional form.

Figure 2:
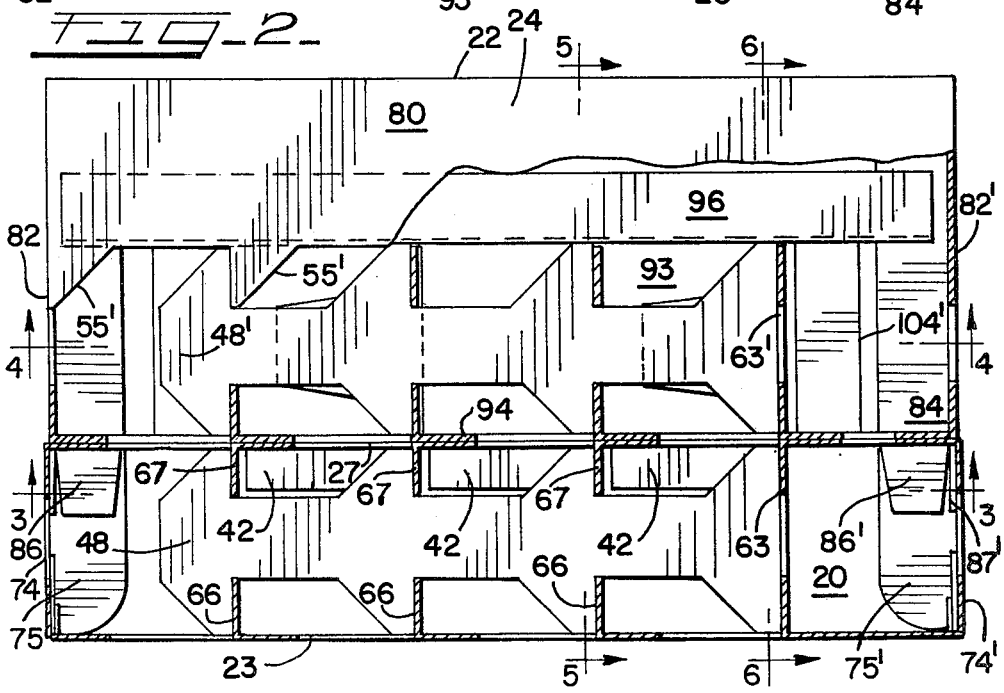
FIG. 2 is a plan view of the carton shown in FIG. 1, with portions broken away.

The blank section 26 which extends from the transverse score line 14 to the end edge 25 of the blank is subdivided by parallel transversely extending, longitudinally spaced score lines 88, 90 and 92 into a latching panel 93, of a width corresponding to that of the panel 38, two adjoining wall-forming panels 94 and 95 of narrower width and a glue panel 96, also of relatively narrow width. The panel 94, which extends between score lines 14 and 88, has a width slightly less than that of the outer sidewall forming panels 22 and 23 and constitutes a cell dividing and partition wall panel for cooperation with the panel 27 in forming a double panel partition wall between the two rows of cells. The panel 95 which extends between the transverse score lines 90 and 92 is the same width as panel 94 and constitutes an innermost partition wall panel separating the innermost row of cells from the space beneath the display panel portion 80 of the top wall and display panel forming section 24 of the blank. The latching panel 93 is provided with two transversely spaced apertures 97, 97', of identical configuration, which are formed by cutting on lines 98, 98'. The apertures 97, 97' have a predetermined configuration and alignment longitudinally of the blank with the adjoining cell structure which is formed by depressing the panel 48' so as to bring the same into flat engagement with the panel 93, the latter being adapted to lie on the bottom wall panel 20 when the carton is in set-up position (FIGS. 1, 2, 4, 5 and 6). The cutting lines 98, 98' have parallel straight line portions 100, 100' which extend between the transverse lines 88, 90 and longitudinally of the blank. The cutting line portion 100' is aligned longitudinally of the blank with hinge score line 53' for the hinge panel 63' of the cell forming structure 38' while the cutting line portion 100 is aligned with a hinge score line 64' of the cell forming structure 38' which is spaced from line 53' in the direction of the other side of the blank. The cutting lines include a pair of diagonal portions 102, 103 and 102', 103' which extend from the score lines 88 and 90 at angles corresponding to the angular relation of the cutting lines 54', 55' with the score line 14 and the cutting lines 52' and the apertures 97, 97' are located so that in the set-up carton, with the panel 93 lying on the bottom wall panel 20 directly beneath the panel structure 38' and the panel 48' depressed the edges formed by the cutting line portions 102, 103 and 102', 103' will be positioned for abutting engagement with spaced pairs of edges formed by cutting on pairs of lines 54', 55' on the panel 48' which are spaced transversely of the blank as shown on FIG. 2. The panel 93 is notched out at opposite sides of the blank 12 at 104 and 104' to provide clearance for the tuck flaps 75, 84 and 75' and 84' of the end closures as shown in FIG. 2.

In fabricating the carton in collapsed condition an adhesive is applied to the top side of panel 96 and preferably to the bottom side of latching tab members 42 as viewed in FIG. 7. The panel 93 is folded on the score line 88 and the panel 27 is folded on the score line 36 into the position shown in FIG. 8. The panel 24 and associated panels are then folded on score line 15 and an adhesive is applied to panel 94 and the associated end closure panel connecting tabs 86, 87 and 86', 87' as illustrated in FIG. 9. The panel 37 and associated panels are folded on the score line 17 to complete the forming of the collapsed carton as shown in FIG. 10.

The collapsed carton may be set up by first opening it into tubular shape and then depressing the panels 48 and 48' until they lie on the bottom wall 20. The panel 93 will be interposed between the panel 48' and the bottom wall 20 in position for the edges 54' 55' to engage the edges 102, 103 and 102', 103'. The tabs 42 will lie on the bottom wall 20 with the edges 44 in position for engagement with the edges 55 on the panel 48.

What is claimed is:

1. A multi-cell carton structure in the form of a tray (10) which is formed from a cut and scored blank (12) of paperboard or similar foldable material, which carton structure comprises a tubular body with a rectangular cross section and having an abutting double row of article receiving cells of relatively shallow depth which open upwardly and which double rows of cells are in side by side relation with the tops thereof in the plane of a top wall forming panel structure (24, 37) which has a dimension lengthwise of the double row of cells substantially greater than the combined width of the rows of cells, so as to provide a display panel (80) having substantial width extending along one side only of the abutting double row of cells, said cells in each of the rows thereof being formed by depressing a panel (48, 48') which is cut in the material constituting the top wall forming panel Structure (24, 37) and which is connected thereto by cross partition forming panel members (63, 63') which cross partition forming panel members (63, 63') are hinged to an upstanding position when said connected panel (48, 48') is depressed and said cross partition forming panel members (63, 63') when in said upstanding position defining one side of each of the cells in the row thereof, said rows of cells being separated only by an upstanding partition panel (94, 27) having a double thickness of material.

2. A carton structure as set forth in claim 1 wherein the tubular body comprises a bottom wall forming panel (20), sidewall forming panels (22, 23) hingedly connected to side edges of the bottom wall forming panel; a top wall forming panel structure (24, 37) which is hingedly connected at its side edges to said sidewall forming panels (22, 23), a partition wall forming panel (95) which is hinged to the top wall panel at the top edge thereof and connected at its bottom edge to the side edge of said cell-forming panel (93) which lies when in the depressed position, on the bottom wall and spaces said partition wall forming panel (95) from said double thickness partition panel (27, 94) to which it is hingedly connected along its opposite side edge whereby said carton may be collapsed when said depressed panels (48, 48') are in a raised position in the plane of the top wall forming panel structure (24, 37).

3. A carton structure as set forth in claim 1 wherein said body comprises hingedly connected top (24, 37), bottom (20), and sidewalls (22, 23) and said upstanding partition panel comprises two panel members (27, 94) in back to back relation which are hinged to the top wall forming panel structure (24, 37) at the top edges and at their bottom edges are hingedly connected to latching means (42, 93) for engaging and holding the cell forming members (48, 48') when said cell forming panel members (48, 48') are in depressed position.

4. A carton structure as set forth in claim 1 wherein said upstanding partition panel separating said rows comprises two panel members (27, 94) in face to face engagement and having at their bottom edges hinged panel means (42, 93) with edge portions (44, 102, 103, 102', 103') engaging said cell forming panels (48, 48') when said cell forming panels are in depressed position, for holding said cell forming panels (48, 48') in said depressed position.

5. A carton structure as set forth in claim 1 wherein said row separating partition panel has means (43, 103, 103') at the bottom thereof for engaging said cell forming panels (48, 48') when said cell forming panels are in depressed cell forming position.

6. A carton structure as set forth in claim 1 wherein said row separating partition panel (27, 94) is hingedly connected at the bottom edge with latching panel means (93) adapted to lie on the bottom wall panel (20) and have abutment means (102, 102', 103, 103') positioned for engagement by portions of said cell forming panels when said cell forming panels (48, 48') are in depressed position so as to hold said cell forming panels in said position.

7. A carton structure as set forth in claim 1 wherein said row separating partition panel (27, 94) has hingedly connected panels (42, 93) at its bottom edge which lie on said bottom wall (20) and present abutment forming edges (44, 103, 103') in position for engagement with abutment forming edges (54', 55) on said cell forming panels so as to hold said cell forming panels in cell forming position.

8. A blank of paperboard or similar foldable sheet material for forming a multi-cell tray-type carton of rectangular configuration said blank (12) being in the form of an elongate generally rectangular sheet which is cut and scored on a plurality of parallel, transversely extending, and longitudinally spaced lines (14, 15, 16, 17, 18) so as to divide the blank into a bottom wall forming panel (20), a pair of sidewall forming panels (22, 23) adjoining said bottom wall forming panel, a top wall and cell forming panel (37) cut to provide a row of cells adjoining the one sidewall forming panel (23) and a partition panel (27) adjoining said cell forming panel, a top wall and cell forming panel (24) having a portion providing a subpanel (77) which is cut and scored to provide a second row of cells adjoining the other one (22) of said pair of said sidewall forming panels, a partition panel (94) separating the rows of cells adjoining said last mentioned top wall and cell forming panel (24), a latching panel (93) for the last mentioned cell forming panel (77) adjoining said partition panel (94) a partition panel (95) adjoining said latching panel (93) and a glue panel (96) adjoining said partition panel (95).

9. A blank for forming a carton as set forth in claim 8 wherein said top wall and cell forming panels (24, 37) have a combined dimension in the direction lengthwise of the blank (12) which corresponds to the dimension of said bottom wall forming panel (20) in the same direction.

10. A blank for forming a carton as set forth in claim 8 wherein said top wall and cell forming panel (24) is cut and scored to provide a strip-like panel (48') extending transversely of the blank with spaced hinge panels which permit moving the strip-like panel (48') out of the plane of the associated top wall forming panel (24) and into a predetermined offset plane position, said strip-like panel (48') being cut to provide abutment forming edge portions (54') forming latching elements and said cell latching panel (93) being cut to provide abutment forming edges (103, 103') located so as to cooperate with the latching elements on said strip-like panel in holding said strip-like panel in cell forming position.

* * * * *

UNITED STATES PATENT AND TRADEMARK OFFICE

CERTIFICATE OF CORRECTION

PATENT NO. : 4,274,579

DATED : June 23, 1981

INVENTOR(S) : Francis V. Kulig

It is certified that error appears in the above-identified patent and that said Letters Patent are hereby corrected as shown below:

Column 4, line 59, "24" should be -- 25 --.

Column 5, line 13, the word "latching" should be omitted.

Signed and Sealed this

*Fifteenth* Day of *September 1981*

[SEAL]

*Attest:*

GERALD J. MOSSINGHOFF

*Attesting Officer*

*Commissioner of Patents and Trademarks*